US008814386B2

(12) United States Patent
So

(10) Patent No.: US 8,814,386 B2
(45) Date of Patent: Aug. 26, 2014

(54) LIGHTING DEVICE SYSTEM AND METHOD

(76) Inventor: Leon So, West Covina, CA (US)

( * ) Notice: Subject to any disclaimer, the term of this patent is extended or adjusted under 35 U.S.C. 154(b) by 344 days.

(21) Appl. No.: 13/167,533

(22) Filed: Jun. 23, 2011

(65) Prior Publication Data

US 2011/0317421 A1 Dec. 29, 2011

Related U.S. Application Data

(60) Provisional application No. 61/357,743, filed on Jun. 23, 2010.

(51) Int. Cl.
*F21S 4/00* (2006.01)

(52) U.S. Cl.
USPC ..... 362/249.02; 362/147; 362/249.03; 362/368

(58) Field of Classification Search
USPC ..... 362/249.02, 249.06, 147, 368
See application file for complete search history.

(56) References Cited

U.S. PATENT DOCUMENTS

| | | | | |
|---|---|---|---|---|
| 4,096,379 | A * | 6/1978 | Taylor | 362/235 |
| 4,413,311 | A * | 11/1983 | Orenstein | 362/219 |
| 4,712,165 | A * | 12/1987 | Cetrone | 362/147 |
| 6,851,831 | B2 * | 2/2005 | Karlicek, Jr. | 362/249.06 |
| 7,080,927 | B2 * | 7/2006 | Feuerborn et al. | 362/368 |
| 7,762,695 | B2 * | 7/2010 | Lanczy | 362/368 |
| 8,425,075 | B1 * | 4/2013 | Falat et al. | 362/145 |

* cited by examiner

*Primary Examiner* — Stephen F Husar
*Assistant Examiner* — James Cranson, Jr.
(74) *Attorney, Agent, or Firm* — James A. Italia; Italia IP

(57) ABSTRACT

A lighting device, system, and method are disclosed. The lighting system includes a connector configured to be coupled with a relatively stationary object. The connector may have a first coupling face. A light source support may be configured to support a plurality of light sources. The light source support may have a second coupling face configured to mechanically and electrically couple with the first coupling face. The second coupling face may be radially symmetric and able to couple with the first coupling face in a first orientation and in a second orientation. The second orientation may be substantially opposite the first orientation.

16 Claims, 4 Drawing Sheets

LIGHTING DEVICE SYSTEM AND METHOD

CROSS REFERENCE TO RELATED APPLICATIONS

The present application claims priority to U.S. Patent Application No. 61/357,743, filed Jun. 23, 2010, entitled "LIGHTING DEVICE SYSTEM AND METHOD," the entire disclosure of which is hereby incorporated by reference in its entirety.

BACKGROUND

This application relates generally to lighting devices and systems. More specifically, this application relates to a lighting device and system having a set of components enabling easy configuration and reconfiguration for selectively changing quantities, and proportions, of direct and/or indirect light provided, and for easy selective configuration and reconfiguration of the physical layout of the light sources included in the system.

SUMMARY

The performance of building occupants can depend on the performance and comfort of the building. One important performance and comfort factor is lighting. Glare control is often neglected as a performance factor. Glare can cause eye fatigue. One strategy for glare control is to provide indirect lighting. Currently lighting devices and systems provide either direct lighting or indirect lighting. Current lighting devices and systems are also limited in their physical layout possibilities.

Therefore, there is a significant need for a lighting device, system, arrangement, and method that can provide in a flexible and selectable way direct lighting and/or indirect lighting in various selectable ratios. There is also a significant need for a lighting system that includes a set of parts to allow for multiple physical arrangement possibilities.

This application discloses a lighting device, system, and method. The lighting system may include a connector having a support coupling configured to be coupled to a stationary object. The connector may have a first coupling face. An LED support may be configured to support a plurality of LEDs. The LED support may have a second coupling face configured to mechanically and electrically couple with the first coupling face. The second coupling face may be radially symmetric and able to couple with the first coupling face in a first orientation and in a second orientation. The second orientation may be substantially opposite the first orientation.

BRIEF DESCRIPTION OF THE DRAWINGS

The drawings, when considered in connection with the following description, are presented for the purpose of facilitating an understanding of the subject matter sought to be protected.

DETAILED DESCRIPTION

While the present lighting device system and method is described with reference to several illustrative embodiments described herein, it should be clear that the present invention should not be limited to such embodiments. Therefore, the description of the embodiments provided herein is illustrative of the present invention and should not limit the scope of the invention. In addition, while the following description references drawings showing particular configurations and proportions, it will be appreciated that the invention may be configured to have other configurations and proportions.

The description may use perspective-based descriptions such as up/down, back/front, and top/bottom. Such descriptions may merely be used to facilitate the discussion and are not intended to restrict the application of embodiments of the present invention.

Figure 1:
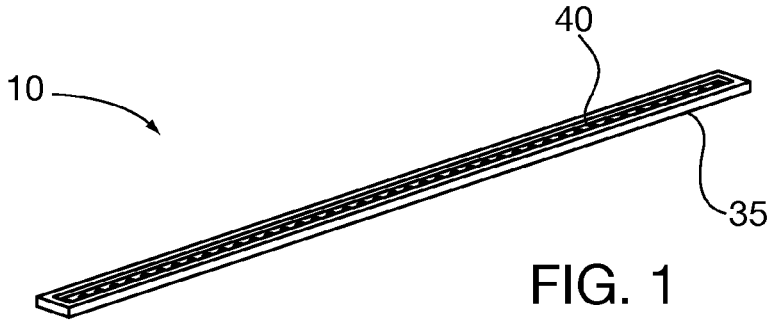
FIG. 1 is a perspective view of a first embodiment of an LED support in accordance with various example embodiments.

Referring now to FIGS. 1-11, wherein various example lighting configurations are illustrated, and made possible with a system 10 configured in accordance with one or more embodiments of the current application. FIG. 1 is a perspective view of a first embodiment of an example light source support 35. The light source support 35 may be configured to support, for example, a plurality of LEDs 40 configured as light sources. Accordingly, the light source support 35 may, in some example cases, be referred to as an LED support 35.

Figure 2:
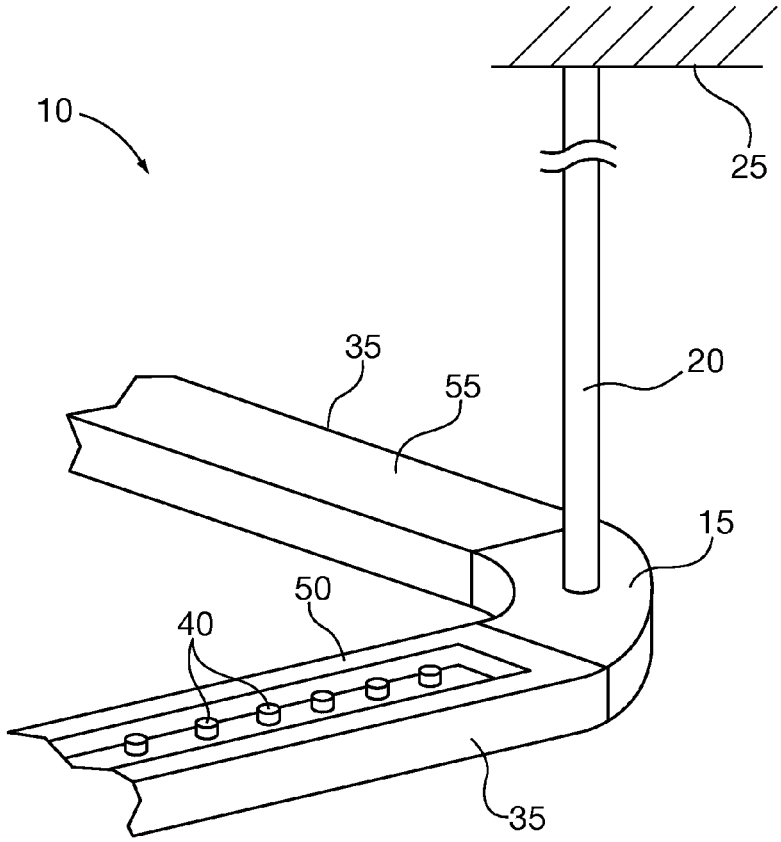
FIG. 2 is a partial perspective view of an example configuration in accordance with various example embodiments.

FIG. 2 shows a first LED support 35 and a second LED support 35 each coupled with a connector 15. Each LED support 35 may be configured to support one, two, or a plurality of LEDs 40.

The example configuration shows a first LED support 35 with LEDs 40 directed upwardly providing indirect light to regions below the lighting configuration, and a second LED support 35, which may be configured the same as, or similar to, the first LED support 35, with LEDs 40 (not visible in this orientation) directed downwardly providing direct light to regions below the lighting configuration. However, the lighting configuration is not limited to the particular arrangement illustrated in FIG. 2. Both the first and second LED supports 35 may direct the LEDs 40 in the same direction, either upwardly or downwardly, which may provide respective indirect, or direct lighting to regions there-below. Further, the LEDs 40 may be high power, low voltage LEDs.

The LED supports 35 may be bar shaped, and may have a coupling face at both ends. The LED supports may be various sizes, one example may be 22"L×1"W×0.5"D.

Some examples may include a subassembly unit that may include, in various combinations, one or more of a power supply, a transformer, a heat sink, and a lighting, for example LED, circuit board. In some cases the subassembly unit may be configured to be installed into the LED support 35, or into the connector 15. Some example systems 10 may provide one or more of the power supply, the transformer, the heat sink, and the circuit board in various combinations in both the LED support 35 and the connector 15. In such cases one or more of the power supply, the transformer, the heat sink, and the circuit board may be selectively disabled in adjustable or selective ways in accordance with the application, or the desire or need of the user. This may provide even greater flexibility for the system.

Figure 9:
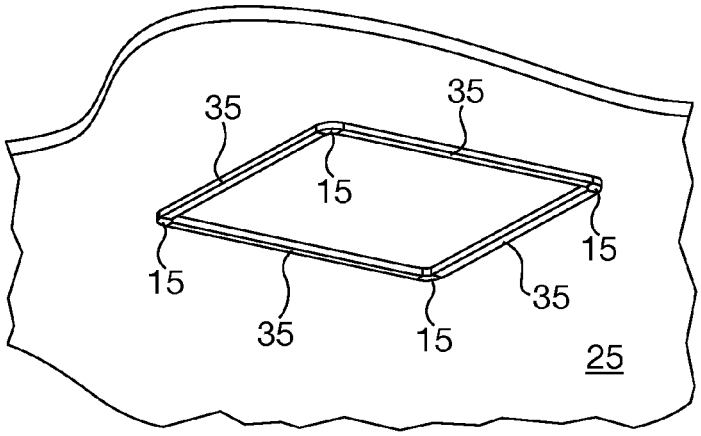
FIG. 9 is a perspective view showing an example surface mount installation for a direct lighting application.

The connector 15 may have a support coupling 20 configured to be coupled to a relatively stationary object 25. The relatively stationary object 25 may be, for example, a ceiling, and the support coupling 20 may be a support rod, or the like configured to suspend the connector 15 from the stationary object 25. The support rod may be a hollow rod that may enable electric wiring to be passed through. Other support means are possible such as, without limitation, wires and the like. The example connector 15 is configured to position the first and second LED supports 35 in substantially the same plane. The LED supports 35 may be positioned substantially perpendicular to each other, or at various angles. As shown in FIG. 9 and discussed below, the connector 15 may be connected directly to a relatively stationary object 25 which may be a surface, for example, a ceiling.

Figure 3:
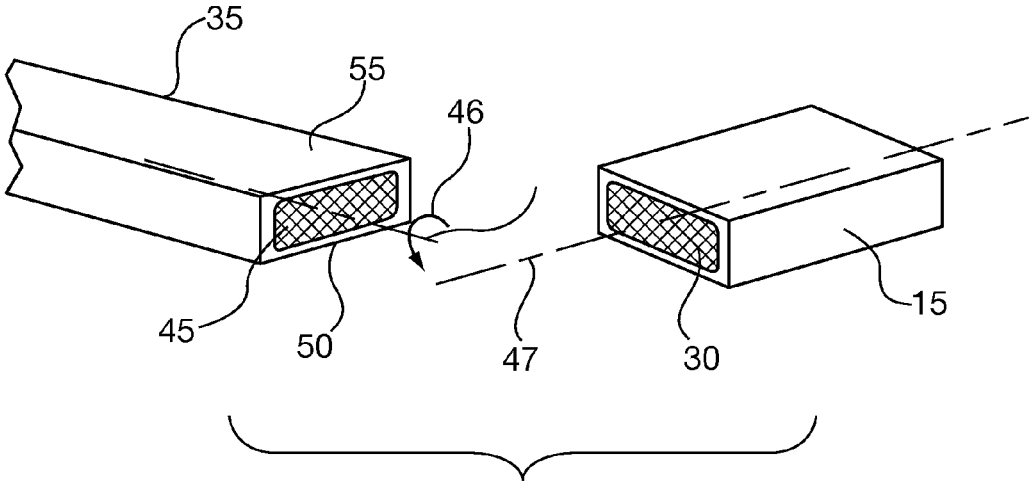
FIG. 3 is a somewhat schematic view showing mating coupling surfaces in accordance with various example embodiments.

FIG. 3 is a somewhat schematic view illustrating another example connector that may be equipped with features the same as, or similar to, features included with the connector 15 shown in FIG. 2. The connector 15 may have a first coupling face 30. The LED support 35 may have a second coupling face 45 configured to mechanically and/or electrically couple with the first coupling face 30 on the connector 15. The LED support 35 and the connector 15 are shown in an unconnected state. It should be understood that the LED support 35 is configured to be aligned with the connector 15, and the first coupling face 30 mated with the second coupling face 45.

One or both of the first and second coupling faces 45 may be radially symmetric. As illustrated by arrow 46 LED support 35 may be rotated about axis 47 and able to couple with the connector via the first and second coupling faces 30, 45 in either a first orientation with a lighted face 50, i.e. with LEDs 40, facing upwardly, or in a second orientation with a non-lighted face 55 facing upwardly, i.e. with LEDs 40, facing downwardly.

Figure 4:
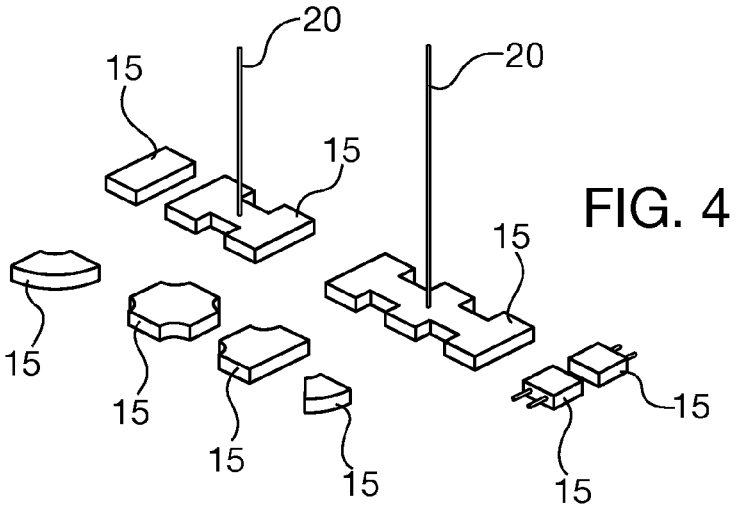
FIG. 4 is a perspective view showing multiple example connectors in accordance with various embodiments.

FIG. 4 is a perspective view showing multiple example connectors in accordance with various example embodiments. Connectors may be configured to orient LED supports at various angles. Example angles may include, without limitation, 30, 60, 45, 90, 135 or 180 degrees. Connectors may also be configured in various shapes, for example, a T to connect 3 LED supports, or an X or cross "+" shape to connect 4 LED supports. Many patterns may then be formed with the combination of LED supports and connectors. For example, a square shape can be produced with four LED supports and four 90 degree connectors. A continuous appearance can be produced with a 180 degree connector.

In some examples, special function connectors may be provided, for example a connector that includes a power supply, a dimming control, ambient light sensor, remote control, and the like. A remote power supply may be included and may be concealed in a connector or in an LED support. A power line may be connected between the power supply and one of the connectors, for example, for a group of connected LED supports. In some examples, an LED support may include AC line voltage power transmission from one end to the other end (line voltage bus).

Figure 5:
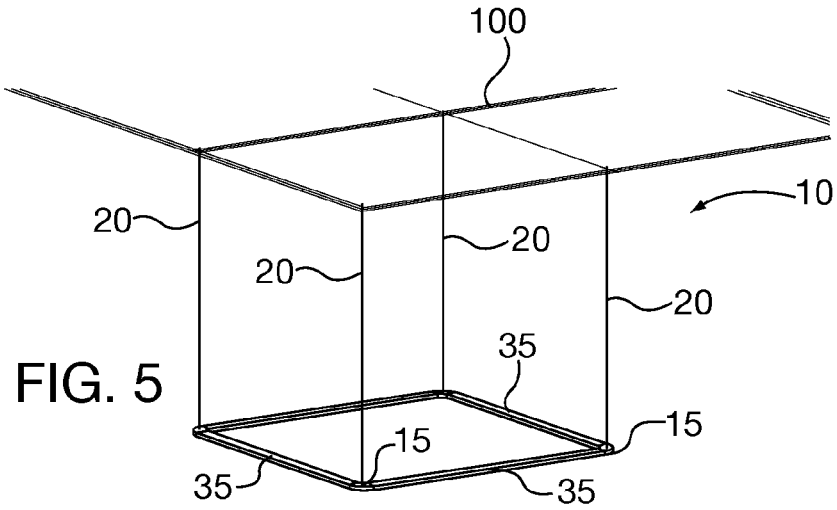
FIG. 5 is a perspective view showing a first example suspended installation.
Figure 6:
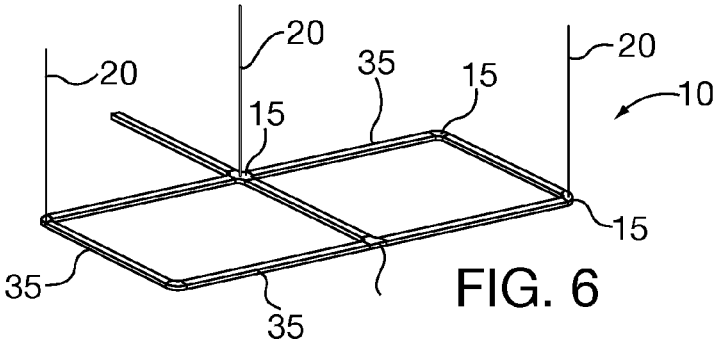
FIG. 6 is a perspective view showing a second example suspended installation.

FIG. 5 is a perspective view showing a first example suspended installation. FIG. 6 is a perspective view showing a second example suspended installation.

Figure 7:
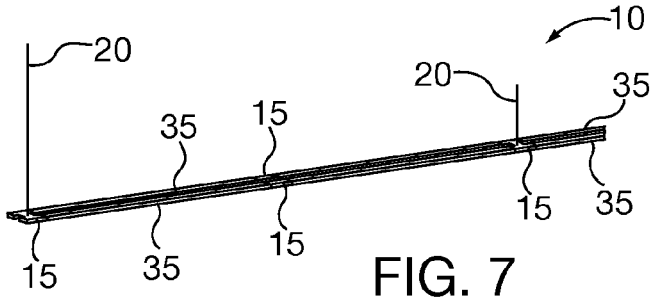
FIG. 7 is a perspective view showing an additional example suspended installation showing two parallel rows of LED supports illustrating 50% direct lighting and 50% indirect lighting.

FIG. 7 is a perspective view showing an additional example suspended installation having a main body of LED supports 35, connectors 15 and support couplings 20. The main body may have, for example, two parallel rows of LED supports 35 providing, for example, 50% direct lighting and 50% indirect lighting. As discussed, the LED supports 35 may be installed with light emitted upward to produce indirect lighting or downward to produce direct lighting. With more than one lighting support installed with a parallel connector a combination of direct and indirect lighting can also be achieved. The combined system may be installed suspended for up-lighting application, down-lighting application, or a combination of both utilizing the parallel connector 15. Of the six LED supports 35 shown in FIG. 7, as an example, three may have light sources, i.e. LEDs directed downwardly, and three may have light sources, i.e. LEDs directed upwardly.

Figure 8:
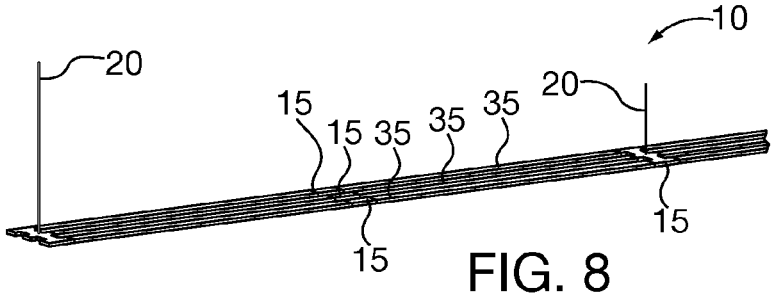
FIG. 8 is a perspective view showing an additional example suspended installation showing two parallel rows of LED supports illustrating 33% direct lighting and 66% indirect lighting.

FIG. 8 is a perspective view showing an additional example suspended installation showing two parallel rows of LED supports illustrating 33% direct lighting and 66% indirect lighting. Utilizing the parallel connector and 180 degree connectors, three continuous straight rows of LED supports 35 may be formed. Two of the three rows may be oriented for up lighting and the middle row may be oriented for down-lighting. This example configuration may be sufficient, for example, to provide high quality lighting for a typical 900 sq ft classroom.

In some examples, a light sensor may be utilized, and included for example in one or more connectors, or in one or more LED supports. The light sensor may sense ambient light sensing, and provide a signal for dimming control to adjust lighting level according to ambient light intensity. In some cases lighting levels may also be adjusted via a remote mounted dimmer.

Figure 10:
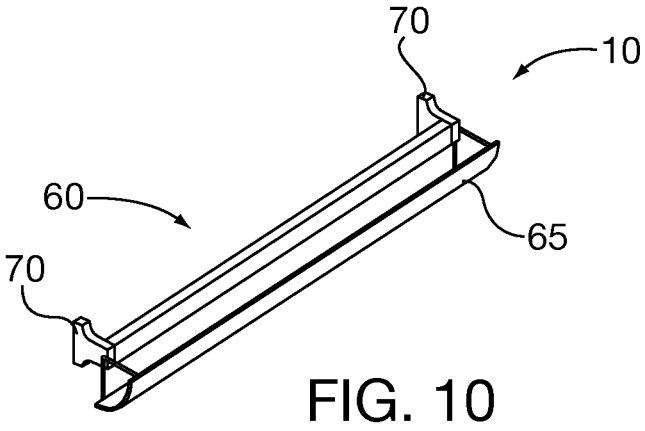
FIG. 10 is a perspective view showing a wall mounted application with light deflector.

FIG. 9 is a perspective view showing an additional example surface mount installation for a direct lighting application. FIG. 10 is a perspective view showing a wall mounted application 60 with light deflector 65. Various optical arrangements can be added to the main body to alter the illumination performance. Such optical arrangement may include, for example, one or more focusing lenses for spot lighting application or diffusing lens for disperse lighting. An optional wall mounting connector 70 may be included for attaching the LED support 35 to the wall. Features such as continuous dimming and day lighting control may be included as optional connections. In some cases, the connectors may be configured to have tilt-able, or rotatable, elements such that the beam direction can be adjusted. Some examples may include the adjustable optics to control beam direction and spread. Various examples may include light deflectors, and/or decorative covers.

Figure 11:
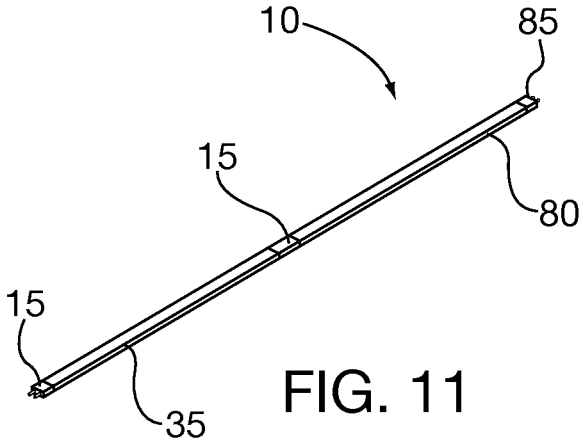
FIG. 11 is a perspective view showing an example use of adaptors in accordance with various example embodiments wherein the system can be used in a retro fit application with, for example, T5, T8, T10, and T12 type lighting applications.

An optional adaptor, or appropriately configured connector 15 may be used for retrofitting of fluorescent tubes, or fluorescent fixtures, or incandescent light sources, or other type of lighting source, may also be included. FIG. 11 is a perspective view showing an example use of adaptors in accordance with various example embodiments wherein the system can be used in a retro fit application with, for example, T5, T8, T10, and T12 type lighting applications.

It should be appreciated that the present invention is not limited to utilizing LEDs for its light source. Any light source currently available, or that becomes available as technology progresses, can be incorporated for use in accordance with the present disclosure.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A lighting system comprising:

a connector configured to be coupled with a relatively stationary object, the connector having a first coupling face; and a light source support configured to support a plurality of light sources, the light source support having a second coupling face configured to mechanically and electrically couple with the first coupling face, the second coupling face being radially symmetric and able to couple with the first coupling face in a first orientation and in a second orientation, the second orientation being substantially opposite the first orientation, wherein the connector is from a set of connectors configured to interconnector two or more light source support, the set of connectors enabling the two or more light source support to be oriented facing upwardly to provide indirect lighting, or facing downwardly to provide direct lighting to objects, surfaces, or persons there-below.

2. A lighting system comprising:

a connector configured to be coupled with a relatively stationary object, the connector having a first coupling face; and a light source support configured to support a plurality of light sources, the light source support having a second coupling face configured to mechanically and electrically couple with the first coupling face, the second coupling face being radially symmetric and able to couple with the first coupling face in a first orientation and in a second orientation, the second orientation being substantially opposite the first orientation, wherein each of the light source supports have a longitudinal dimension and a transverse dimension, the longitudinal dimension being substantially longer than the transverse dimension, each light source support having at least one of said second coupling face on an end thereof, the set of connectors configured to interconnect two light source support in respective preselected angular orientations.

3. The lighting system of claim 2, wherein the preselected angular orientations is selected from the set including 30 degrees, 45 degrees, 60 degrees, 90 degrees, 135 degrees, and 180 degrees.

4. A lighting system comprising:

a connector configured to be coupled with a relatively stationary object, the connector having a first coupling face; and a light source support configured to support a plurality of light sources, the light source support having a second coupling face configured to mechanically and electrically couple with the first coupling face, the second coupling face being radially symmetric and able to couple with the first coupling face in a first orientation and in a second orientation, the second orientation being substantially opposite the first orientation;

further comprising an elongate support coupling having a first end and a second end, the first end configured to couple with the relatively stationary object and the second end configured to couple with the connector such that the connector is suspended from the stationary object at a spaced apart location from the stationary object.

5. A lighting system comprising:

a connector configured to be coupled with a relatively stationary object, the connector having a first coupling face; and a light source support configured to support a plurality of light sources, the light source support having a second coupling face configured to mechanically and electrically couple with the first coupling face, the second coupling face being radially symmetric and able to couple with the first coupling face in a first orientation and in a second orientation, the second orientation being substantially opposite the first orientation, wherein the light source support is an LED support configured to support a plurality of LED along a length of the LED support.

6. A lighting system comprising:

a connector configured to be coupled with a relatively stationary object, the connector having a first coupling face; and a light source support configured to support a plurality of light sources, the light source support having a second coupling face configured to mechanically and electrically couple with the first coupling face, the second coupling face being radially symmetric and able to couple with the first coupling face in a first orientation and in a second orientation, the second orientation being substantially opposite the first orientation;

further comprising one or more additional connectors wherein the connector and/or the one or more additional connectors are one of T shaped, H shaped, X shaped, and cross shaped.

7. A method for configuring a lighting arrangement comprising:

supporting a first connector, a second connector, and a third connector;

coupling a first elongate lighting support having light sources on one surface thereof at a first end to the first connector, and at a second end to the second connector, orienting the first elongate lighting support at a first orientation to provide indirect lighting to occupants below the lighting arrangement; and coupling a second elongate lighting support having light sources on one surface thereof at a first end to the second connector, and at a second end to the third connector, orienting the second elongate lighting support at a second orientation to provide direct lighting to occupants below the lighting arrangement.

8. The method of claim 7, further comprising selecting the first elongate lighting support such that the light sources are LEDs; and selecting the second elongate lighting support such that the light sources are LEDs.

9. The method of claim 7, wherein the first and second elongate lighting supports are first and second LED supports.

10. The method of claim 7, wherein the supporting a first connector, a second connector, and a third connector includes suspending the first, second, and third connectors with respective first, second, and third support couplings from a relatively fixed surface.

11. The method of claim 7, further comprising:

uncoupling the first lighting support from the first coupling;

rotating the first lighting support about a longitudinal axis approximately 180 deg; and recoupling the first lighting support to the first coupling.

12. The method of claim 7, further comprising coupling a third lighting support to the third connector wherein the third lighting support includes at least one lighting source which is one or more or an incandescent light source and a fluorescent light source.

13. A lighting system comprising:

a connector configured to be suspended from a stationary object by a support coupling, the connector having a first coupling face; and an LED support configured to support a plurality of LEDs, the LED support having a second coupling face configured to mechanically and electrically couple with the first coupling face, the second coupling face being radially symmetric and able to couple with the first coupling face in a first orientation and in a second orientation, the second orientation being substantially opposite the first orientation.

14. The lighting system of claim 13, wherein the connector is from a set of connectors configured to interconnector two or more LED supports, the set of connectors enabling the two or more LED supports to be oriented facing upwardly to provide indirect lighting, or facing downwardly.

15. The lighting system of claim 14, wherein Each of the LED supports have a longitudinal dimension and a transverse dimension, the longitudinal dimension being substantially longer than the transverse dimension, each LED support having at least one of said second coupling face on an end thereof, the set of connectors configured to interconnect two LED supports in respective preselected angular orientations.

16. The lighting system of claim 15, wherein the preselected angular orientations is selected from the set including 30 degrees, 45 degrees, 60 degrees, 90 degrees, 135 degrees, and 180 degrees.

* * * * *